US010336591B1

(12) United States Patent
McLean

(10) Patent No.: US 10,336,591 B1
(45) Date of Patent: Jul. 2, 2019

(54) PORTABLE WHEEL LIFTING SYSTEM

(71) Applicant: Olla McLean, Richmond, TX (US)

(72) Inventor: Olla McLean, Richmond, TX (US)

( * ) Notice: Subject to any disclaimer, the term of this patent is extended or adjusted under 35 U.S.C. 154(b) by 0 days.

(21) Appl. No.: 15/704,392

(22) Filed: Sep. 14, 2017

Related U.S. Application Data

(60) Provisional application No. 62/394,639, filed on Sep. 14, 2016.

(51) Int. Cl.

| | |
|---|---|
| ***B66F 5/02*** | (2006.01) |
| *B66F 3/08* | (2006.01) |
| *B66F 3/22* | (2006.01) |
| *B66F 7/02* | (2006.01) |

(52) U.S. Cl.
CPC ..... *B66F 5/025* (2013.01); *B66F 3/08* (2013.01); *B66F 3/22* (2013.01); *B66F 7/025* (2013.01)

(58) Field of Classification Search
CPC .... B66F 5/025; B66F 3/08; B66F 3/22; B66F 7/025; B66F 7/06–7/0683; B66F 7/246; B66F 9/06; B66F 5/00; B66F 5/02; B66F 2700/04; B66F 2700/12; B66F 1/00; B66F 3/00; B66F 3/12; B66F 7/26; B60B 30/02; B60B 30/10; B60B 29/00; B60B 29/006
USPC ..... 254/7 C
See application file for complete search history.

(56) References Cited

U.S. PATENT DOCUMENTS

| | | | | |
|---|---|---|---|---|
| 1,847,382 | A * | 3/1932 | Collins | B60B 29/002 414/428 |
| 2,725,997 | A * | 12/1955 | Shvetz | B60B 29/002 414/427 |
| 5,085,407 | A * | 2/1992 | Lonon | B66F 3/44 254/103 |
| 6,098,961 | A * | 8/2000 | Gionet | B66F 7/065 254/122 |
| 6,695,289 | B1 * | 2/2004 | Mickael | B66F 3/12 187/211 |
| 7,207,548 | B1 * | 4/2007 | Howe | B66F 3/00 254/98 |
| 7,597,524 | B2 * | 10/2009 | Hernandez | B60B 29/002 414/426 |
| 8,112,837 | B1 * | 2/2012 | Lopez | B25H 3/006 254/126 |
| 9,440,491 | B1 * | 9/2016 | Belliveau | B60B 30/10 |
| 9,566,826 | B2 * | 2/2017 | Yaschur | B60B 30/02 |
| 2004/0146384 | A1 * | 7/2004 | Whelan | B60S 13/00 414/426 |
| 2015/0137055 | A1 * | 5/2015 | Ong | B66F 5/025 254/7 B |

* cited by examiner

*Primary Examiner* — Sean K. Hunter
*Assistant Examiner* — Thomas Raymond Rodgers
(74) *Attorney, Agent, or Firm* — Eldredge Law Firm, LLC; Richard Eldredge; Beth Felix

(57) ABSTRACT

A portable wheel lifting system to assist in the replacement of a wheel on a vehicle utilizing a portable outer housing, an inner lifting linkage system to hold a wheel or tire in place, and an electrical motor to vertically raise the lifting linkage system and thus the wheel to the desired location.

4 Claims, 5 Drawing Sheets

PORTABLE WHEEL LIFTING SYSTEM

BACKGROUND

1. Field of the Invention

The present invention relates generally to wheel lifting systems, and more specifically, a power-assist wheel positioning system which aids the user in changing a tire.

2. Description of Related Art

Replacing a wheel on a vehicle due to a flat tire or other scenario is a common problem and is well known in the art. In FIGS. 1A & 1B, a conventional wheel replacement method 101 is shown. The vehicle 103 must be lifted using a jack system 107 in order to remove the damaged wheel. The replacement wheel 109 must be manually rolled into place by the user. Finally, the user must lift the replacement wheel 109 from the ground while attempting to align the lug holes 111 in the wheel 109 with the axle studs 105. This task is very difficult due to the inherent weight of the wheel 109 and the lack of visibility of the lugs holes 111 and wheel studs 105. These challenges commonly prevent users from being able to change a wheel on vehicles.

Although great strides have been made in conventional wheel replacement methods, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
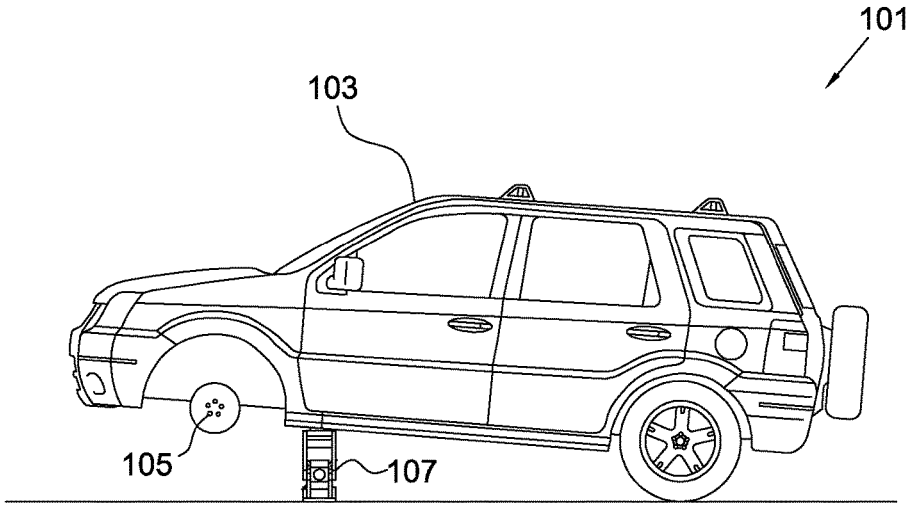
FIG. 1A (PRIOR ART)
FIGS. 1A & 1B are front views of a conventional wheel changing method.
Figure 1B:
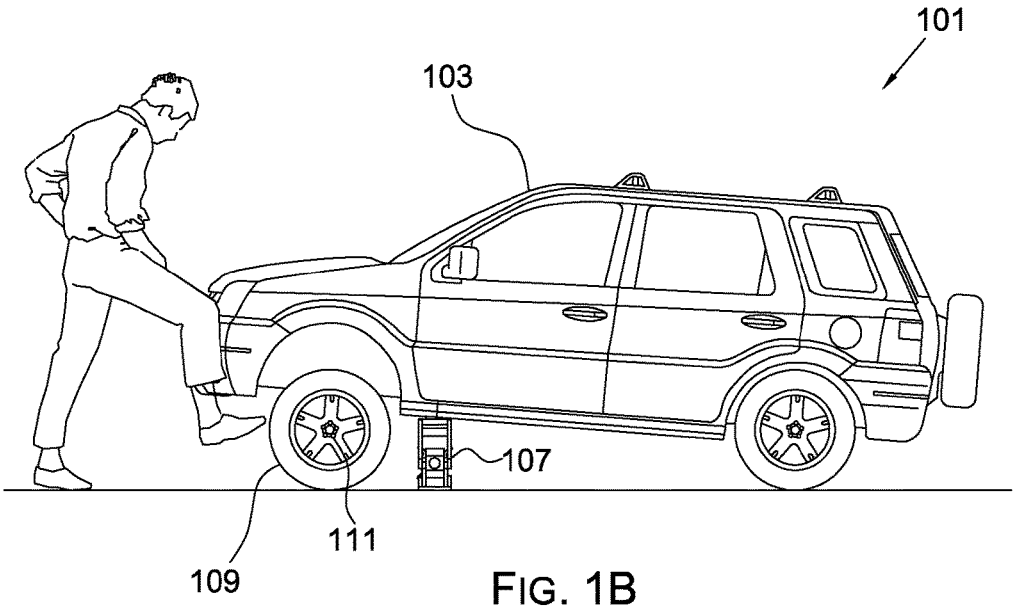
FIG. 1B (PRIOR ART)

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional wheel changing methods. Specifically, the system of the present application provides the user with a portable means of positioning a wheel, which is to be installed on a vehicle's axle studs, while using a minimal amount of effort. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
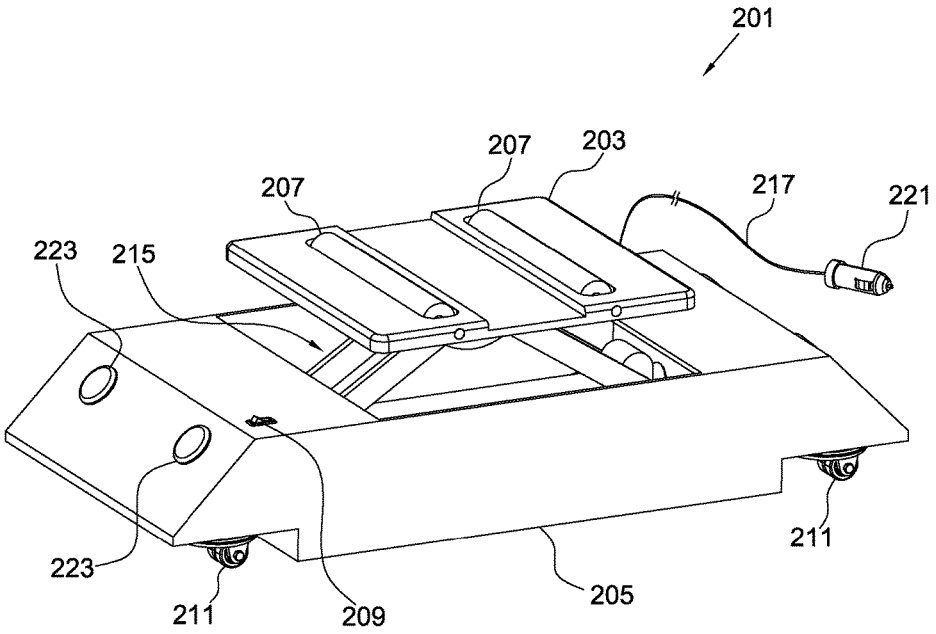
FIG. 2 is an oblique view of a portable wheel positioning system in accordance with a preferred embodiment of the present application.

Referring now to the drawings wherein like reference characters identify corresponding or similar elements throughout the several views, FIG. 2 depicts a portable wheel positioning system in accordance with a preferred embodiment of the present application. It will be appreciated that the portable wheel positioning system 201 overcomes one or more of the above-listed problems commonly associated with conventional wheel changing methods.

In a preferred embodiment, system 201 includes a lifting linkage system 215 which is housed and supported by an outer housing 205. A roller plate 203 is removably attached to the lifting linkage 215 and provides a support for one or more rollers 207. The lifting linkage 215 can be electrically powered by a power supply connector 221 and cable 217 which is readily available for use in most vehicles. The lifting linkage 215, roller plate 203, and rollers 207 can be traversed vertically using one or more electrical switches 209. One or more emergency lights 223 are included in the housing 205 which provide safety illumination during use. One or more caster wheels 211 are attached to the housing 205 which provide a means of portability.

Figure 3:
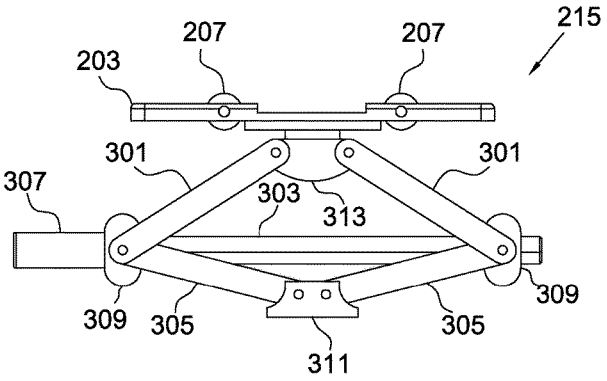
FIG. 3 is a front view of the lifting linkage of FIG. 2.

Referring now to FIG. 3, a front view of the lifting linkage system 215 of system 201 is respectively shown. The lifting linkage system preferably includes one or more lower links 305 which are pivotably attached to the linkage base 311 and threaded blocks 309. One or more of upper links 301 are pivotably attached to the lifting yoke 313 and threaded blocks 309. The threaded shaft 303 passes through one or more threaded blocks 309. The threaded shaft 303 is turned by motor 307 causing the lifting yoke 313 to traverse vertically with a high mechanical advantage. This is viewed as an advantage of the system of the present application.

Figure 4:
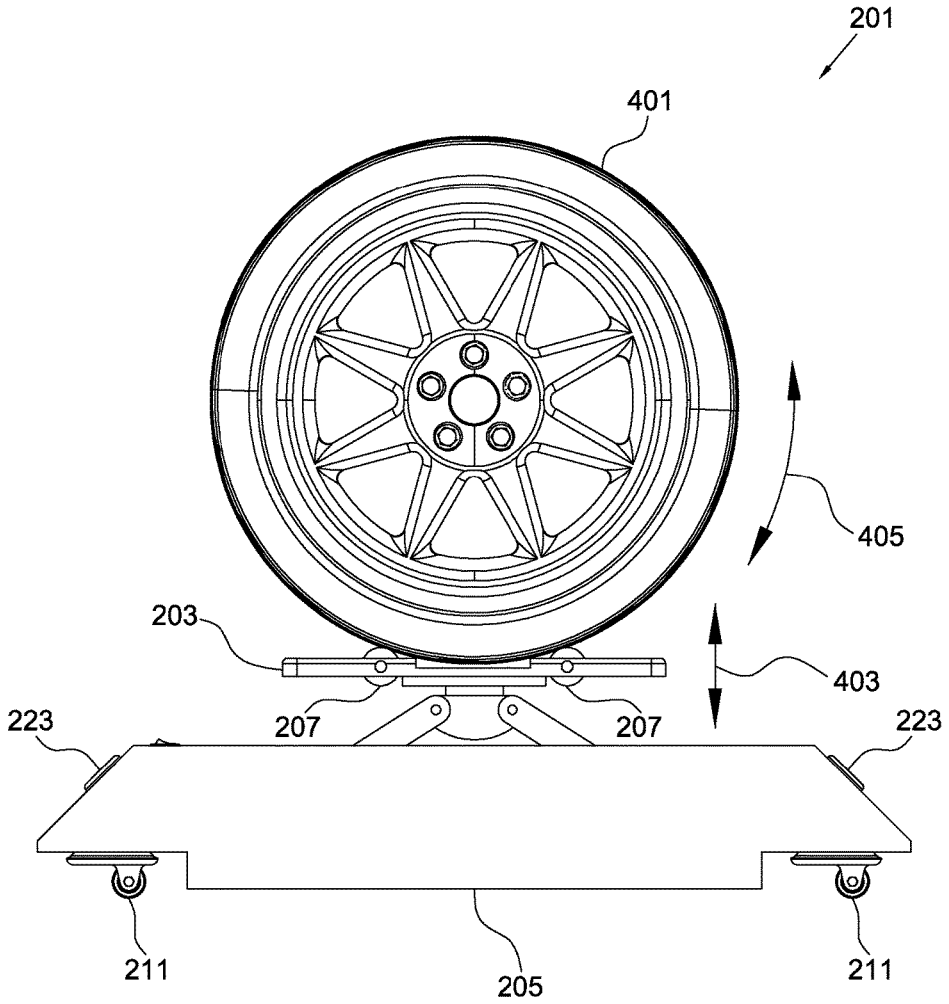
FIG. 4 is a front view of the wheel positioning system of FIG. 2.

Referring now to FIG. 4, a front view of the portable wheel positioning system 201 is depicted. The replacement wheel 401 can be placed on the rollers 207 by rolling it up the inclined sides of the outer housing 205. The wheel 401 is restricted to rotational motion in the direction of arrows 405 once it is resting on the rollers 207. The rollers 207 provide a means for the user to rotate the wheel 401 in order to align the lugs holes with the axle studs on the vehicle. This is viewed as another advantage of the system of the present application. In addition, the user can traverse the wheel 401 vertically in directions 403 in order to align the center of the wheel 401 with the center of the vehicle's axle hub. This is viewed as another advantage of the system of the present application.

As shown in FIG. 2, the lifting linkage system 215 is disposed within an inner cavity formed by the housing 205. During use, the roller plate is moved in a direction away from the inner cavity to a desired height to engage with the tire, as shown in FIG. 4.

Figure 5A:
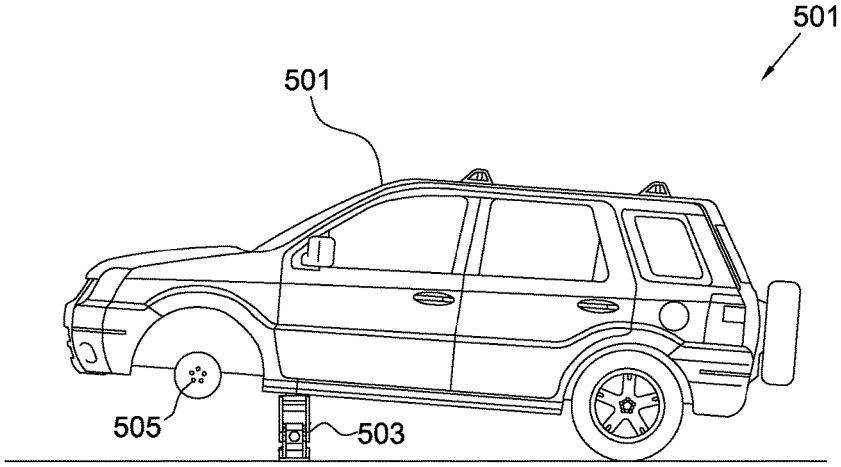
FIGS. 5A, 5B, & 5C are front views of the method of use of the wheel positioning system of FIG. 2.
Figure 5B:
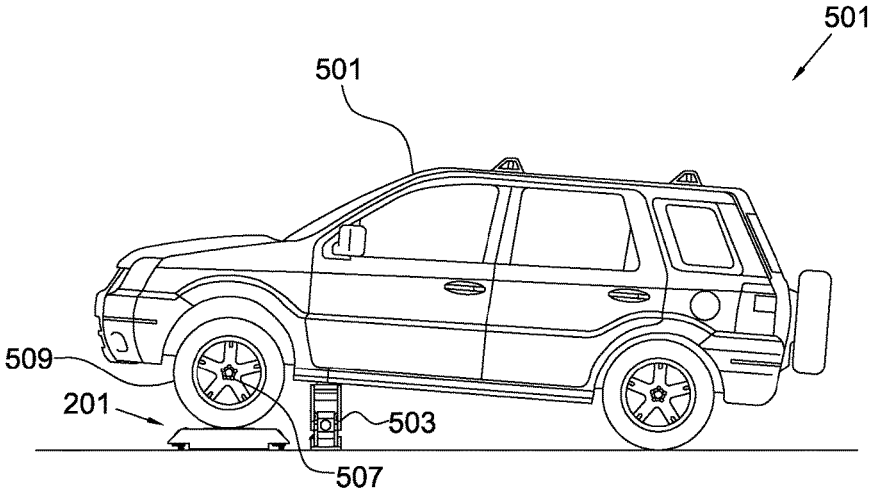
Figure 5C:
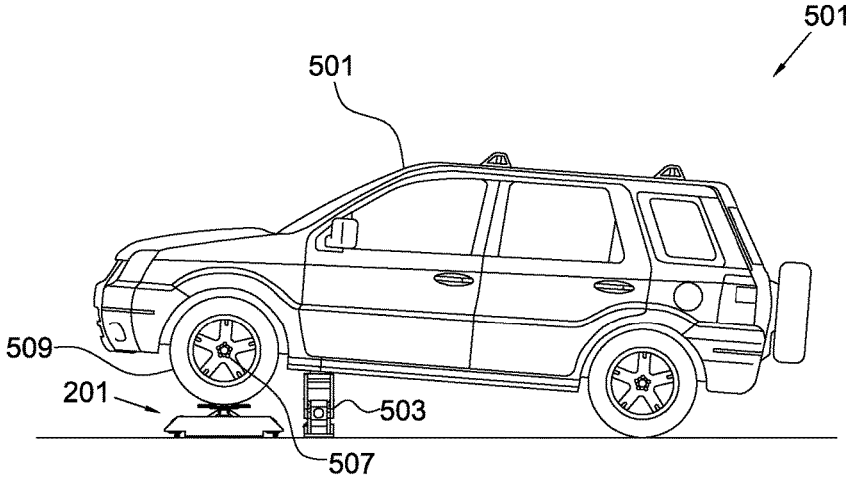

Referring now to FIGS. 5A, 5B & 5C, front views of the method of use 501 is given. In FIG. 5A, the user lifts the vehicle using vehicle jack 503 and removes the damaged wheel. In FIG, 5B, the user places the replacement wheel 509 on system 201 and rolls system 201 to the appropriate installation location. In FIG. 5C, the user lifts the replacement wheel 509 using system 201 to align the center of the wheel 509 to the center of the vehicle's axle hub. The user rotates the replacement wheel 509 to align the wheel lug holes 507 with the vehicles axle studs 505. Finally, the user pushes the replacement wheel 509 onto the vehicle's axle studs 505 and installs the lug nuts (not shown).

It is contemplated that an alternative embodiment could exist which excludes the motor 307 from the lifting linkage system 215. In this alternative embodiment, the screw could be manually turned using an offset handle or knob.

It is also contemplated that alternative linkages and mechanisms could be used in place of the linkage system 215 as a means of traversing the rollers plate 203 and rollers 217.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A portable wheel lifting system, comprising:

an outer housing forming a cavity therein, the outer housing having:

at least two side walls inclined vertically towards a top of the outer housing;

an emergency light secured to the housing; and an electrical switch secured to the housing;

a power supply connector configured to receive power from a vehicle and power the emergency light and the switch;

a lifting linkage system carried within the cavity of the outer housing and configured to extend in a direction upward outside the cavity, the linkage system having:

a first lower link;

a second lower link;

a first upper link;

a second upper link;

a first block pivotally attached to the first lower link and the first upper link; and a second block pivotally attached to the second lower link and the second upper link;

a roller plate secured to the first upper link and the second upper link;

a first roller secured to the roller plate;

a second roller secured to the roller plate;

a threaded shaft engaged with the first block and the second block;

a motor rotatably attached to the threaded shaft, the motor is configured to rotate the threaded shaft, which in turn raises the roller plate outside the cavity of the outer housing; and a plurality of wheels secured to the outer housing;

wherein the lifting linkage system receives power from the housing via activation of the electric switch to raise and lower the lifting linkage system; and wherein rotation of the threaded shaft via the motor pushes the first block and the second block together, thereby causing the first lower link and the first upper link to pivot apart, as well as the second lower link and the second upper link to pivot apart, thereby raising the roller plate outside the cavity.

2. The portable wheel lifting system of claim 1, wherein the outer housing further comprises:

the at least two side walls being inclined toward the top of the outer housing;

a base integrally connected to a bottom of each of the at least two side walls;

a top wall integrally connected to a top of each of the at least two side walls;

an aperture extending through a thickness of the top configured so that the lifting linkage system may extend upward through the aperture.

3. The portable wheel lifting system of claim 1, wherein the lifting linkage system further comprises a linkage base connected to at least one of the lower links.

4. The portable wheel lifting system of claim 1, wherein the lifting linkage system further comprises a lifting yoke connected to at least one of the upper links.

* * * * *